US007309263B2

(12) United States Patent
Copper et al.

(10) Patent No.: US 7,309,263 B2
(45) Date of Patent: Dec. 18, 2007

(54) COMBINATION WEDGE TAP CONNECTOR

(75) Inventors: Charles D. Copper, Harrisburg, PA (US); Ned E. Corman, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/437,480

(22) Filed: May 18, 2006

(65) Prior Publication Data

US 2007/0270046 A1 Nov. 22, 2007

(51) Int. Cl.
*H01R 4/44* (2006.01)

(52) U.S. Cl. ..... 439/781; 439/284; 439/292

(58) Field of Classification Search ..... 439/781, 439/783, 784, 782, 284; 174/94 R, 94 S
See application file for complete search history.

(56) References Cited

U.S. PATENT DOCUMENTS 4,247,159 A * 1/1981 Fruchard ..... 439/431
4,279,461 A * 7/1981 Bussen et al. ..... 439/783
4,471,159 A * 9/1984 Frank, Jr. ..... 174/94 R
4,684,196 A * 8/1987 Smith et al. ..... 439/411
4,723,921 A * 2/1988 Pooley ..... 439/783
4,764,131 A * 8/1988 Beinhaur ..... 439/781
4,915,653 A * 4/1990 Mair ..... 439/781
5,342,224 A * 8/1994 Lefavour ..... 439/781
5,692,930 A * 12/1997 Garver et al. ..... 439/781
5,704,816 A * 1/1998 Polidori ..... 439/781
5,752,860 A * 5/1998 Greaves ..... 439/781
6,004,165 A * 12/1999 Dinh et al. ..... 439/783
6,086,406 A * 7/2000 Francois et al. ..... 439/402
6,595,472 B1 7/2003 Pisczak

OTHER PUBLICATIONS

J.D. Sprecher, J. Schindler, B. Johnson, G. Menechella, R.S. Timsit, Wedge-Connector Technology in Power Utility Applications, AMP Journal of Technology, Jun. 1996, pp. 4-13, vol. 5, Tyco Electronics Corporation, Middletown, PA.

* cited by examiner

*Primary Examiner*—Renee Luebke
*Assistant Examiner*—Harshad C Patel

(57) ABSTRACT

An electrical connector assembly for a utility power transmission system includes a first conductive member having a first hook portion and a first base wedge portion with the first hook portion extending from the first wedge portion and is adapted to engage a main conductor. A second conductive member includes a hook portion and a wedge portion with the hook portion extending from the wedge portion and adapted to engage a tap conductor. The wedge portion of the first conductive member and the wedge portion of the second conductive member are adapted to nest with one another and be secured to one another by hand without specialized tooling. The assembly further comprises a displacement stop that is located on at least one of the first and second conductive members once fully mated. The displacement stop is positioned to define a final displacement relation between the first and second conductive members. The displacement stop defines a final mating position between the first and second conductive members independent of an amount of force induced upon the main and tap conductors by the first and second conductive members.

23 Claims, 7 Drawing Sheets

COMBINATION WEDGE TAP CONNECTOR

BACKGROUND OF THE INVENTION

This invention relates generally to electrical connectors, and more particularly, to power utility connectors for mechanically and electrically connecting a tap or distribution conductor to a main electrical transmission conductor.

Electrical utility firms constructing, operating and maintaining overhead and/or underground power distribution networks and systems utilize connectors to tap main power transmission conductors and feed electrical power to distribution line conductors, sometimes referred to as tap conductors. The main power line conductors and the tap conductors are typically high voltage cables that are relatively large in diameter, and the main power line conductor may be differently sized from the tap conductor, requiring specially designed connector components to adequately connect tap conductors to main power line conductors. Generally speaking, three types of connectors are commonly used for such purposes, namely bolt-on connectors, compression-type connectors, and wedge connectors.

Bolt-on connectors typically employ die-cast metal connector pieces or connector halves formed as mirror images of one another, sometimes referred to as clam shell connectors. Each of the connector halves defines opposing channels that axially receive the main power conductor and the tap conductor, respectively, and the connector halves are bolted to one another to clamp the metal connector pieces to the conductors. Such bolt-on connectors have been widely accepted in the industry primarily due to their ease of installation, but such connectors are not without disadvantages. For example, proper installation of such connectors is often dependent upon predetermined torque requirements of the bolt connection to achieve adequate connectivity of the main and tap conductors. Applied torque in tightening the bolted connection generates tensile force in the bolt that, in turn, creates normal force on the conductors between the connector halves. Applicable torque requirements, however, may or may not be actually achieved in the field and even if the bolt is properly tightened to the proper torque requirements initially, over time, and because of relative movement of the conductors relative to the connector pieces or compressible deformation of the cables and/or the connector pieces over time, the effective clamping force may be considerably reduced. Additionally, the force produced in the bolt is dependent upon frictional forces in the threads of the bolt, which may vary considerably and lead to inconsistent application of force among different connectors.

Compression connectors, instead of utilizing separate connector pieces, may include a single metal piece connector that is bent or deformed around the main power conductor and the tap conductor to clamp them to one another. Such compression connectors are generally available at a lower cost than bolt-on connectors, but are more difficult to install. Hand tools are often utilized to bend the connector around the cables, and because the quality of the connection is dependent upon the relative strength and skill of the installer, widely varying quality of connections may result. Poorly installed or improperly installed compression connectors can present reliability issues in power distribution systems.

Wedge connectors are also known that include a C-shaped channel member that hooks over the main power conductor and the tap conductor, and a wedge member having channels in its opposing sides is driven through the C-shaped member, deflecting the ends of the C-shaped member and clamping the conductors between the channels in the wedge member and the ends of the C-shaped member. One such wedge connector is commercially available from Tyco Electronics Corporation of Harrisburg, Pa. and is known as an AMPACT Tap or Stirrup Connector. AMPACT connectors, however, tend to be more expensive than either bolt-on or compression connectors, and special application tooling, using explosive cartridges packed with gunpowder, has been developed to drive the wedge member into the C-shaped member. Different connectors and tools are available for various sizes of conductors in the field.

AMPACT connectors are believed to provide superior performance over bolt-on and compression connectors. For example, the AMPACT connector results in a wiping contact surface that, unlike bolt-on and compression connectors, is stable, repeatable, and consistently applied to the conductors, and the quality of the mechanical and electrical connection is not as dependent on torque requirements and/or relative skill of the installer. Additionally, and unlike bolt-on or compression connectors, because of the deflection of the ends of the C-shaped member some elastic range is present wherein the ends of the C-shaped member may spring back and compensate for relative compressible deformation or movement of the conductors with respect to the wedge and/or the C-shaped member.

It would be desirable to provide a lower cost, more universally applicable alternative to conventional wedge connectors that provides superior connection performance to bolt-on and compression connectors.

BRIEF DESCRIPTION OF THE INVENTION

According to an exemplary embodiment, an electrical connector assembly is provided. The assembly comprises a first conductive member comprising a first hook portion and a first base wedge portion, the first hook portion extending from the first wedge portion and adapted to engage a first conductor. A second conductive member is also provided that comprises a hook portion and a wedge portion; the hook portion extending from the wedge portion and adapted to engage a second conductor. The wedge portion of the first conductive member and the wedge portion of the second conductive member are adapted to nest with one another and be secured to one another. The assembly further comprises a displacement stop that is located on at least one of the first and second conductive members. The displacement stop is positioned to define a final displacement relation between the first and second conductive members once fully mated. The displacement stop defines a final mating position between the first and second conductive members independent of an amount of force induced upon the first and second conductors by the first and second conductive members.

Optionally, the first wedge portion and the second wedge portion are substantially identically formed, and each of the wedge portions includes a wiping contact surface. A fastener may couple the first wedge portion to the second wedge portion, and the fastener may extending obliquely to fastener bores through which the fastener is extended.

According to another embodiment, an electrical connector assembly for power utility transmission conductors is provided. The assembly comprises a first conductive member and a second conductive member separately fabricated from one another. Each of the first and second conductive members comprises a wedge portion and a deflectable channel portion extending from the wedge portion, and the channel portion is adapted to receive a conductor at a spaced location from the wedge portion. The wedge portion of the first conductive member and the wedge portion of the second conductive member are configured to nest with one another and be secured to one another, and a fastener extends through the wedge portion of each of the first and second conductive members to join the first and second conductive members to one another.

According to still another embodiment, an electrical connector system for power utility transmission is provided. The assembly comprises a main power line conductor, a tap line conductor, and a first conductive member and a second conductive member separately fabricated from one another. Each of the first and second conductive member comprise a wedge portion and a deflectable channel portion extending from the wedge portion. The channel portion of the first conductive member receives the main power line conductor at a spaced location from the wedge portion, the channel portion of the second conductive member engages the tap line conductor at a spaced location from the wedge portion, and the wedge portions of the first and second conductive members are in abutting contact and interfitting with one another. A fastener joins the wedge portion of the first and second conductive members to one another. The main power line conductor is captured between the channel portion of the first conductive member and the wedge portion of the second conductive member, and the tap line conductor is captured between the channel portion of the second conductive member and the wedge portion of the first conductive member.

DETAILED DESCRIPTION OF THE INVENTION

Figure 10:
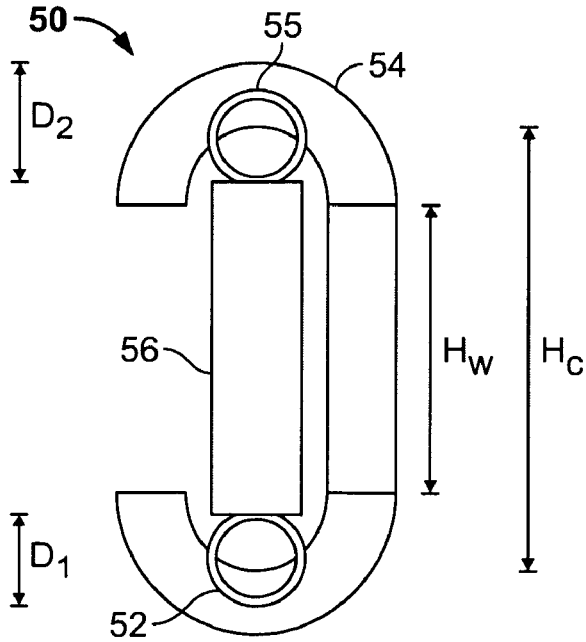
FIG. 10 (Prior Art)
FIG. 10 is a side elevational view of a known wedge connector assembly.
Figure 11:
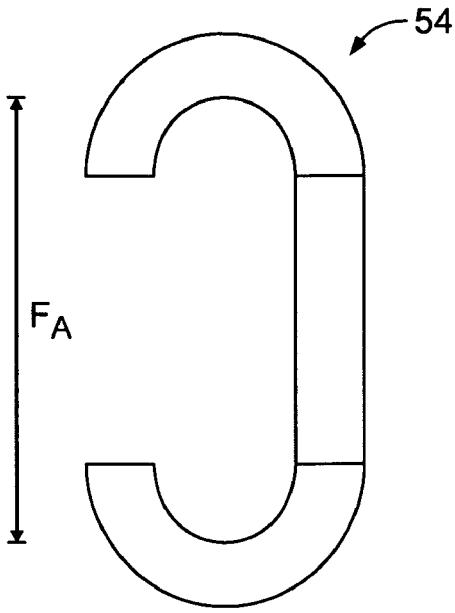
FIG. 11 (Prior Art)
FIG. 11 is a side elevational view of a portion of the assembly shown in FIG. 10.

FIGS. 10 and 11 illustrate a known wedge connector assembly 50 for power utility applications wherein mechanical and electrical connections between a tap or distribution conductor 52 and a main power conductor 55 are to be established. The connector assembly 50 includes a C-shaped member 54 and a wedge member 56. The C-shaped member hooks over the main power conductor 55 and the tap conductor 52, and the wedge member 56 is driven through the C-shaped member 54 to clamp the conductors 52, 55 between the ends of the wedge member 56 and the ends of the C-shaped member 54.

The wedge member 56 may be installed with special tooling having for example, gunpowder packed cartridges, and as the wedge member 56 is forced into the C-shaped member 54, the ends of the C-shaped member are deflected outwardly and away from one another via the applied force $F_A$ shown in FIG. 11. As shown in FIG. 10, the wedge member 56 has a height $H_W$, while the C-shaped member 54 has an height $H_C$ between opposing ends of the C-shaped member where the conductors 52, 55 are received. The tap conductor 52 has a first diameter $D_1$ and the main conductor 55 has a second diameter $D_2$ that may be the same or different from $D_1$. As is evident from FIG. 11, $H_W$ and $H_C$ are selected to produce an interference at each end of the C-shaped member 54 and the respective conductor 52, 55. Specifically, the interference I is established by the relationship:

$$I=H_W+D_1+D_2-H_C \quad (1)$$

With strategic selection of $H_W$ and $H_C$ the actual interference I achieved may be varied for different diameters $D_1$ and $D_2$ of the conductors 52 and 55. Alternatively, $H_W$ and $H_C$ may be selected to produce a desired amount of interference I for various diameters $D_1$ and $D_2$ of the conductors 52 and 55. Consistent generation of at least a minimum amount of interference I results in a consistent application of applied force $F_A$ which will now be explained in relation to FIG. 12.

Figure 12:
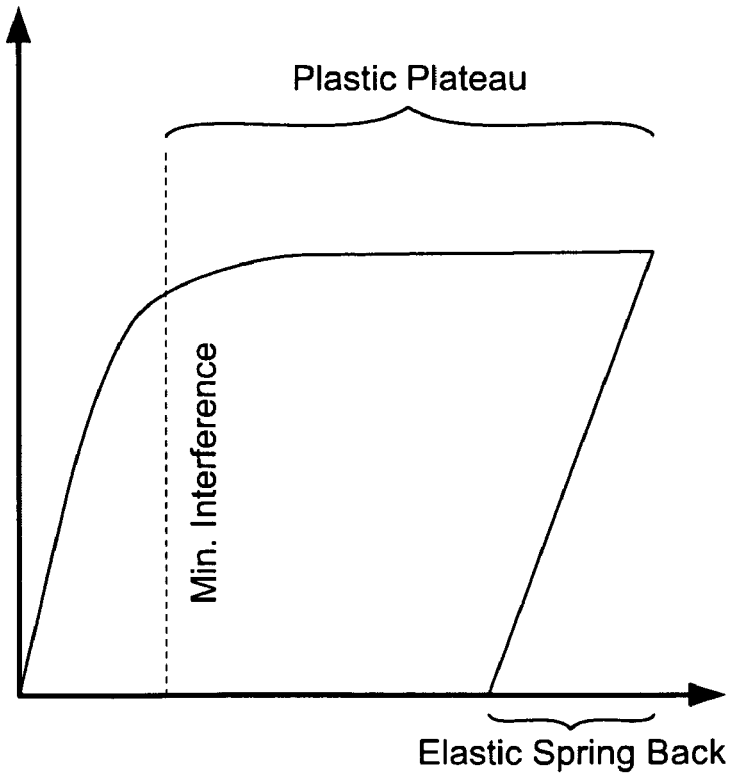
FIG. 12 is a force/displacement graph for the assembly shown in FIG. 10.

FIG. 12 illustrates an exemplary force versus displacement curve for the assembly 50 shown in FIG. 10. The vertical axis represents the applied force, Fa, and the horizontal axis represents displacement of the ends of the C-shaped member 54 as the wedge member 56 is driven into engagement with the conductors 52, 55 and the C-shaped member 54. As FIG. 12 demonstrates, certain amount of interference I, indicated in FIG. 12 with a vertical dashed line, results in plastic deformation of the C-shaped member 54 that, in turn, provides a consistent clamping force on the conductors 52 and 55, indicated by plastic plateau in FIG. 12. The plastic and elastic behavior of the C-shaped member 54 is believed to provide a repeatability in clamping force on the conductors that is not possible with known bolt-on connectors or compression connectors. A need for specialized application tooling for such a connector assembly 50, together with an inventory of differently sized C-shaped members 54 and wedge members 56, renders the connector assembly 50 more expensive and less convenient than some user's desire.

Figure 1:
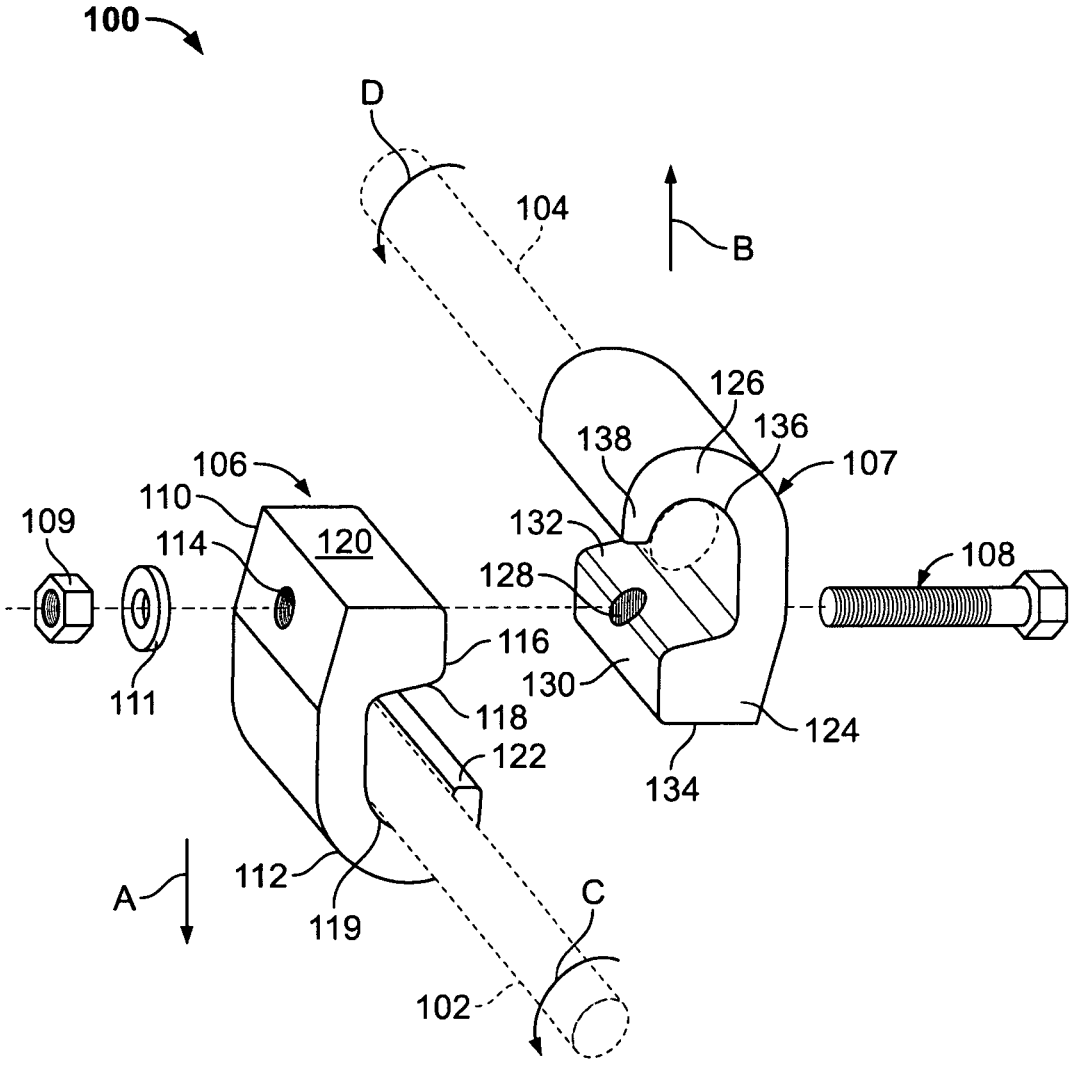
FIG. 1 is an exploded view of a connector assembly formed in accordance with an exemplary embodiment of the invention.

FIG. 1 is an exploded view of a connector assembly 100 formed in accordance with an exemplary embodiment of the invention and that overcomes these and other disadvantages. The connector assembly 100 is adapted for use as a tap connector for connecting a tap conductor 102 (shown in phantom in FIG. 1), to a main conductor 104 (also shown in FIG. 1) of a utility power distribution system. As explained in detail below, the connector assembly 100 provides superior performance and reliability to known bolt-on and compression connectors, while providing ease of installation and lower cost relative to known wedge connector systems.

The tap conductor 102, sometimes referred to as a distribution conductor, may be a known high voltage cable or line having a generally cylindrical form in an exemplary embodiment. The main conductor 104 may also be a generally cylindrical high voltage cable line. The tap conductor 102 and the main conductor 104 may be of the same wire gage or different wire gage in different applications and the connector assembly 100 is adapted to accommodate a range of wire gages for each of the tap conductor 102 and the main conductor 104.

When installed to the tap conductor 102 and the main conductor 104, the connector assembly 100 provides electrical connectivity between the main conductor 104 and the tap conductor 102 to feed electrical power from the main conductor 104 to the tap conductor 102 in, for example, an electrical utility power distribution system. The power distribution system may include a number of main conductors 104 of the same or different wire gage, and a number of tap conductors 102 of the same or different wire gage. The connector assembly 100 may be used to provide tap connections between main conductors 104 and tap conductors 102 in the manner explained below.

As shown in FIG. 1, the connector assembly 100 includes a tap conductive member 106, a main conductive member 107, and a fastener 108 that couples the tap conductive member 106 and the main conductive member 107 to one another. In an exemplary embodiment, the fastener 108 is a threaded member inserted through the respective conductive members 106 and 107, and a nut 109 and lock washer 111 are provided to engage an end of the fastener 108 when the conductive members 106 and 107 are assembled. In one embodiment, an inner diameter of the fastener bore 114 is larger than an outer diameter of the fastener 108, thereby providing some relative freedom of movement of the fastener 108 with respect to the fastener bore 114. While specific fastener elements 108, 109 and 111 are illustrated in FIG. 1, it is understood that other known fasteners may alternatively be used if desired.

The tap conductive member 106 includes a wedge portion 110 and a channel portion 112 extending from the wedge portion 110. A fastener bore 114 is formed in and extends through the wedge portion 110, and the wedge portion 110 further includes an abutment face 116, a wiping contact surface 118 angled with respect to the abutment face 116, and a conductor contact surface 120 extending substantially perpendicular to the abutment face 116 and obliquely with respect to the wiping contact surface 118.

The channel portion 112 extends away from the wedge portion 110 and forms a channel or cradle 119 adapted to receive the tap conductor 102 at a spaced relation from the wedge portion 110. A distal end 122 of the channel portion 112 includes a radial bend that wraps around the tap conductor 102 for about 180 circumferential degrees in an exemplary embodiment, such that the distal end 122 faces toward the wedge portion 110, and the wedge portion 110 overhangs the channel or cradle 119. The channel portion 112 is reminiscent of a hook in one embodiment, and the wedge portion 110 and the channel portion 112 together resemble the shape of an inverted question mark. The tap conductive member 106 may be integrally formed and fabricated from extruded metal, together with the wedge and channel portions 110, 112 in a relatively straightforward and low cost manner.

The main conductive member 107 likewise includes a wedge portion 124 and a channel portion 126 extending from the wedge portion 124. A fastener bore 128 is formed in and extends through the wedge portion 124, and the wedge portion 124 further includes an abutment face 130, a wiping contact surface 132 angled with respect to the abutment face 130, and a conductor contact surface 134 extending substantially perpendicular to the abutment face 130 and obliquely with respect to the wiping contact surface 132. In one embodiment, an inner diameter of the fastener bore 128 is larger than an outer diameter of the fastener 108, thereby providing some relative freedom of movement of the fastener 108 with respect to the fastener bore 128 as the conductive members 106 and 107 are mated as explained below.

The channel portion 126 extends away from the wedge portion 124 and forms a channel or cradle 136 adapted to receive the main conductor 104 at a spaced relation from the wedge portion 124. A distal end 138 of the channel portion 126 includes a radial bend that wraps around the main conductor 104 for about 180 circumferential degrees in an exemplary embodiment, such that the distal end 138 faces toward the wedge portion 124, and the channel 136 overhangs the wedge portion 124. The channel portion 126 is reminiscent of a hook in one embodiment, and the wedge portion 124 and the channel portion 126 together resemble the shape of a question mark. The main conductive member 107 may be integrally formed and fabricated from extruded metal, together with the wedge and channel portions 124, 126 in a relatively straightforward and low cost manner.

The tap conductive member 106 and the main conductive member 107 are separately fabricated from one another or otherwise formed into discrete connector components and are assembled to one another as explained below. While one exemplary shape of the tap and main conductive members 106, 107 has been described herein, it is recognized that the conductive members 106, 107 may be alternatively shaped in other embodiments as desired.

In one embodiment, the wedge portions 110 and 124 of the respective tap and the main conductive members 106, 107 are substantially identically formed and share the same geometric profile and dimensions to facilitate interfitting of the wedge portions 110 and 124 in the manner explained below as the conductive members 106, 107 are mated. The channel portions 112, 126 of the conductive members 106 and 107, however, may be differently dimensioned as appropriate to be engaged to differently sized conductors 102, 104 while maintaining substantially the same shape of the conductive members 106, 107. Identical formation of the wedge portions 110 and 124 provides for mixing and matching of conductive members 106 and 107 for differently sized conductors 102, 104 while achieving a repeatable and reliable connecting interface via the wedge portions 110 and 124.

As shown in FIG. 1, the tap conductive member 106 and the main conductive member 107 are generally inverted relative to one another with the respective wedge portions 110 and 124 facing one another and the fastener bores 114, 128 aligned with one another to facilitate extension of the fastener 108 therethrough. The channel portion 112 of the tap conductive member 106 extends away from the wedge portion 110 in a first direction, indicated by the arrow A, and the channel portion 126 of the main conductive member 107 extends from the wedge portion 124 in a second direction, indicated by arrow B that is opposite to the direction of arrow A. Additionally, the channel portion 112 of the tap conductive member 106 extends around the tap conductor 102 in a circumferential direction indicated by the arrow C, while the channel portion 126 of the main conductive member 107 extends circumferentially around the main conductor 104 in the direction of arrow D that is opposite to arrow C.

Figure 2:
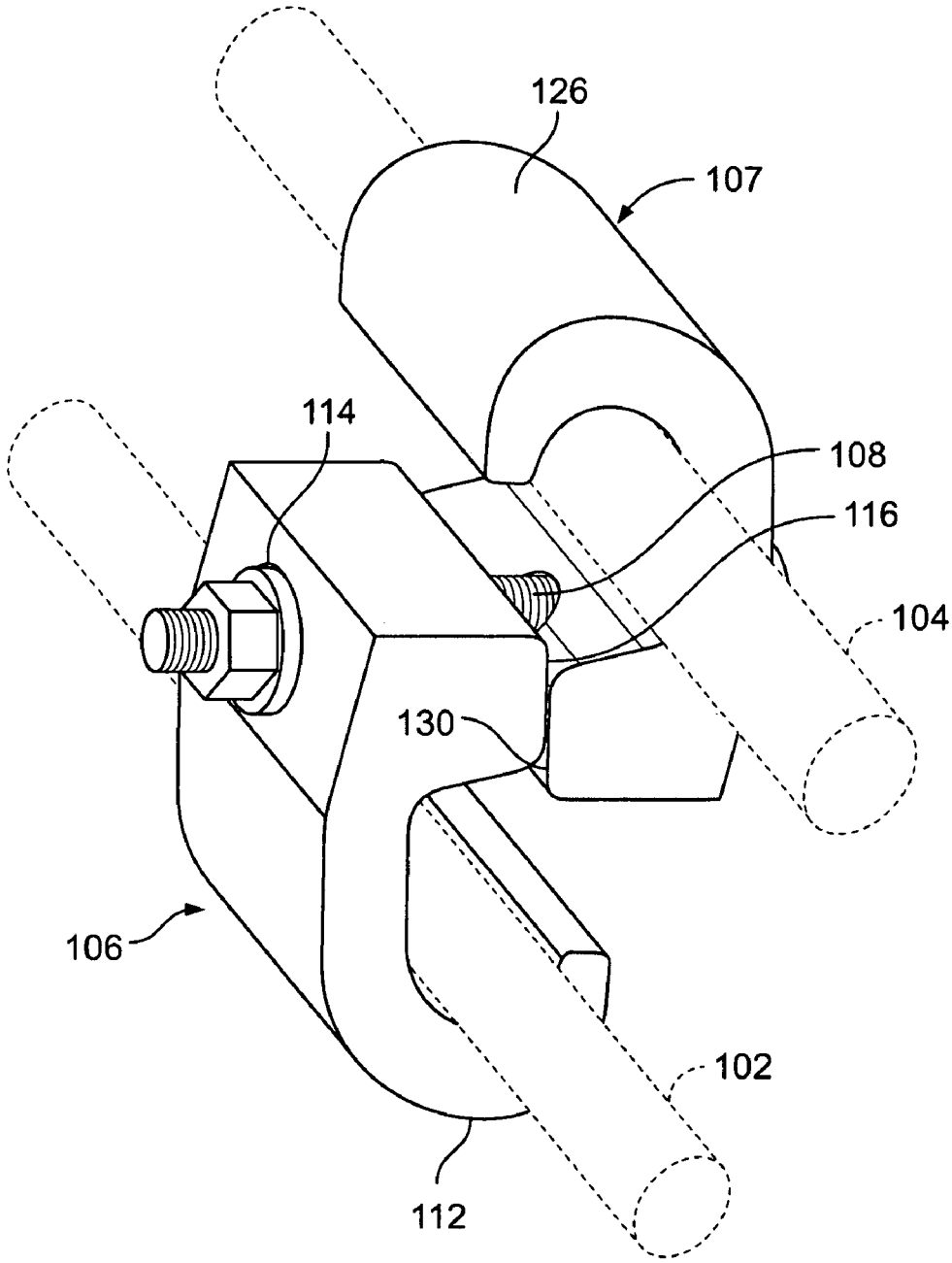
FIG. 2 is a perspective view of the assembly shown in FIG. 1 in an unmated position.
Figure 3:
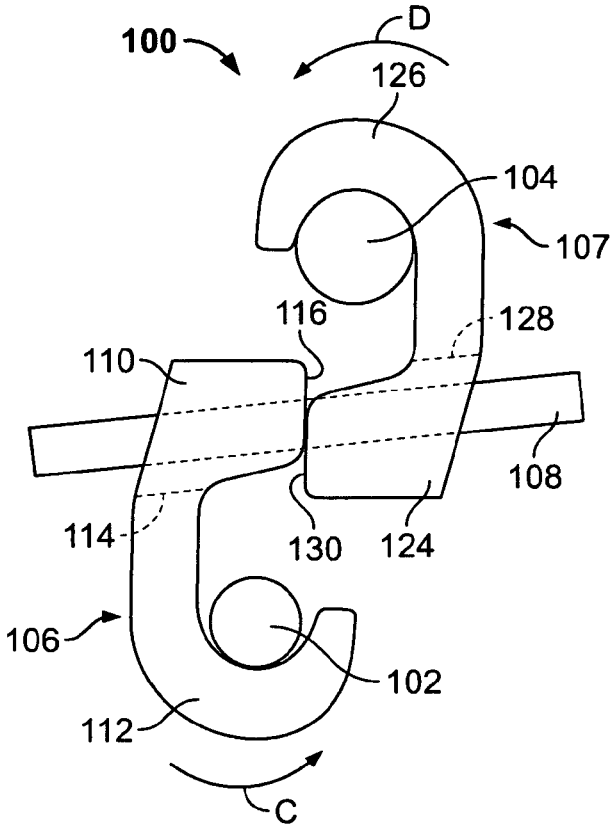
FIG. 3 is a side elevational view of the assembly shown in FIG. 2 in a fully opened or unmated position.

When the channel portions 112, 126 are hooked over the respective conductors 102, 104 and the when the conductive member 106, 107 are coupled together by the fastener elements 108, 109, 111, the abutment faces 116, 130 are aligned in an unmated condition as shown in perspective view in FIG. 2, and in side elevational view in FIG. 3. The connector assembly 100 may be preassembled into the configuration shown in FIGS. 2 and 3, and hooked over the conductors 102 and 104 in the directions of arrows C and D relatively easily. As seen in FIG. 3, and because the inner diameters of the fastener bores 114, 128 (shown in phantom in FIG. 3) are larger than an outer diameter of the fastener 108, the fastener 108 is positionable in a first angular orientation through the wedge portions 110 and 124.

Figure 4:
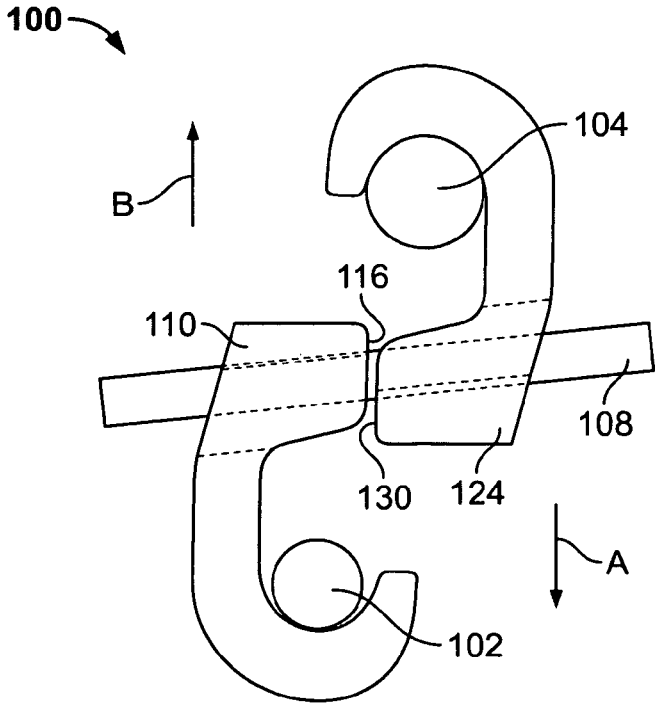
FIG. 4 is another side elevational view of the assembly shown in FIG. 2 in a first intermediate position.
Figure 5:
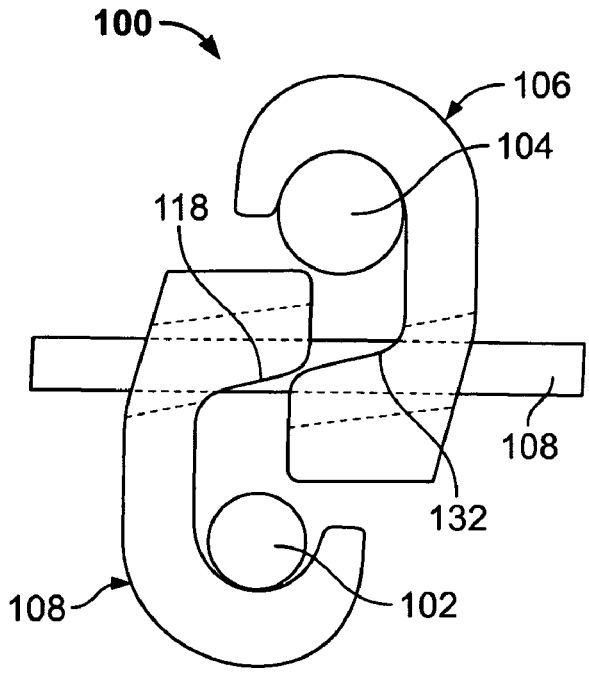
FIG. 5 is a side elevational view of the assembly shown in FIG. 2 in a second intermediate position.
Figure 6:
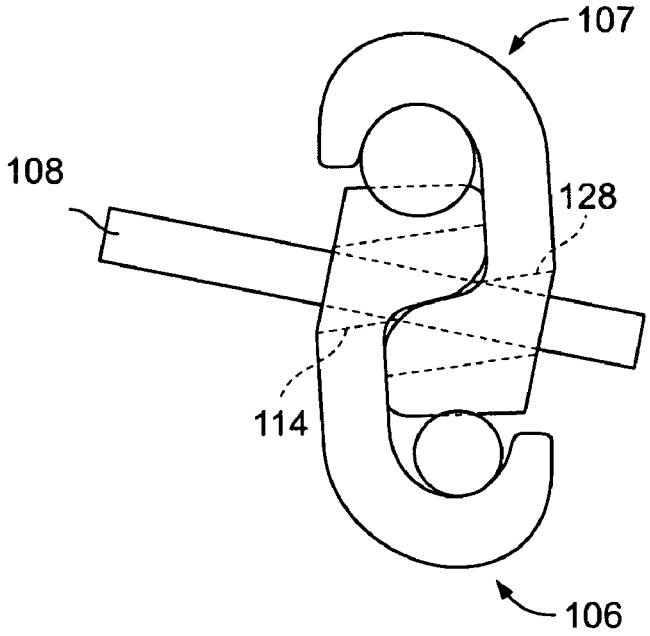
FIG. 6 is a side elevational view of the assembly shown in FIG. 2 in a fully closed or mated position.

As illustrated in FIGS. 4-6, the larger diameter of the fastener bores 114, 128 relative to the fastener 108 permits the fastener 108 to float or move angularly with respect to an axis of the bores 114, 128 as the conductive members 106, 107 are moved to a fully mated position. More particularly, the abutment faces 116, 130 of the wedge portions 110, 124 are moved in sliding contact with one another in the directions of arrows A and B as shown in FIG. 4 until the wiping contact surfaces 118, 132 are brought into engagement as shown in FIG. 5, and the wedge portions 110, 124 may then be moved transversely into a nested or interfitted relationship as shown in FIG. 6 with the wiping contact surfaces 118, 132 in sliding engagement. All the while, and as demonstrated in FIGS. 4-6, the fastener 108 self adjusts its angular position with respect to the fastener bores as the fastener 108 moves from the initial position shown in FIG. 3 to a final position shown in FIG. 6. In the final position shown in FIG. 6, the fastener 108 extends obliquely to each of the fastener bores 114, 128, and the nut 109 may be tightened to the fastener 108 to secure the conductive members 106, 107 to one another.

Figure 7:
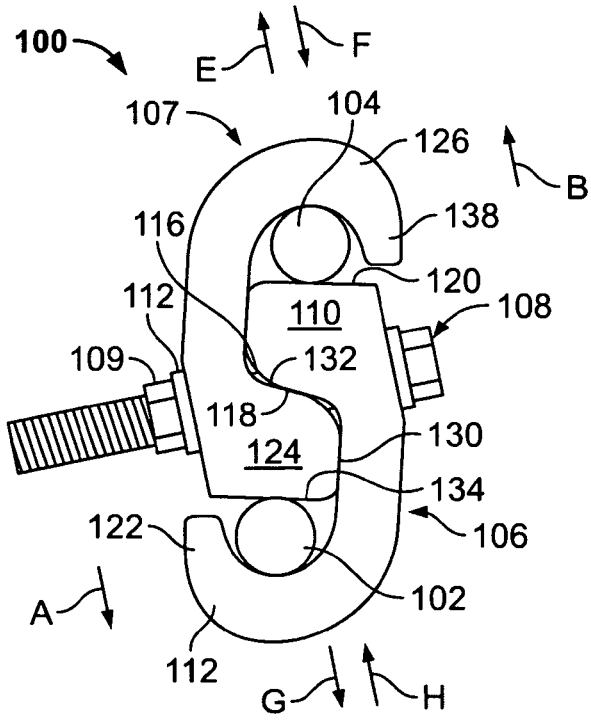
FIG. 7 is another side elevational view of the assembly shown in FIG. 2 in the mated condition.

FIG. 7 illustrates the connector assembly 100 in a fully mated position with the nut 109 tightened to the fastener 108. As the conductive members 106, 107 are moved through the positions shown in FIGS. 4-6, the wiping contact surfaces 118, 132 slidably engage one another and provide a wiping contact interface that ensures adequate electrically connectivity. The angled wiping contact surfaces 118, 132 provide a ramped contact interface that displaces the conductor contact surfaces 120, 134 in opposite directions indicated by arrows A and B as the wiping contact surfaces 118, 132 are engaged. In addition, the conductor contact surfaces 120, 134 provide wiping contact interfaces with the conductors 102 and 104 as the connector assembly 100 is installed.

Movement of the conductor contact surfaces 120, 134 in the opposite directions of arrows A and B clamps the conductors 102 and 104 between the wedge portions 110 and 124, and the opposing channel portions 112, 126. The distal ends 122, 138 of the channel portions 112, 126 are brought adjacent to the wedge portions 110, 124 to the mated position shown in FIGS. 6 and 7, thereby substantially enclosing portions of the conductors 102, 104 within the connector assembly 100. Eventually, the abutment faces 116, 130 of the wedge portions 110, 124 contact the channel portions 126, 112 of the opposing conductive members 107 and 106, and the connector assembly 100 is fully mated. In such a position, the wedge portions 110, 124 are nested or mated with one another in an interfitting relationship with the wiping contact surfaces 118 and 132, the abutment faces 116 and 130, and the channel portions 112 and 126 providing multiple points of mechanical and electrical contact to ensure electrical connectivity between the conductive members 106 and 107.

In the fully mated position shown in FIGS. 6 and 7, the main conductor 104 is captured between the channel portion 126 of the main conductive member 107 and the conductor contact surface 120 of the tap conductive member wedge portion 110. Likewise, the tap conductor 102 is captured between the channel portion 112 of the tap conductive member 106 and the conductor contact surface 134 of the main conductive member wedge portion 124. As the wedge portion 110 engages the tap conductive member 106 and clamps the main conductor 104 against the channel portion 126 of the main conductive member 107 the channel portion 126 is deflected in the direction of Arrow E. The channel portion 126 is elastically and plastically deflected in a radial direction indicated by arrow E, resulting in a spring back force in the direction of Arrow F, opposite to the direction of arrow E to provide a clamping force on the conductor. A large contact force, on the order of about 4000 lbs is provided in an exemplary embodiment, and the clamping force ensures adequate electrical connectivity between the main conductor 104 and the connector assembly 100. Additionally, elastic spring back of the channel portion 126 provides some tolerance for deformation or compressibility of the main conductor 104 over time, because the channel portion 126 may effectively return in the direction of arrow F if the main conductor 104 deforms due to compression forces. Actual clamping forces may be lessened in such a condition, but not to such a mount as to compromise the integrity of the electrical connection.

When fully mated, the abutment faces 116 and 130 engage the channel portions 126 and 112 to form a displacement stop that defines and limits a final displacement relation between the tap and main conductive members 106 and 107. The displacement stop defines a final mating position between the tap and main conductive members 106 and 107 independent of an amount of force induced upon the main and tap conductors 104 and 102 by the main and tap conductive members 107 and 106.

Optionally, the displacement stop may be created from a stand off provided on one or both of the main and tap conductive members 107 and 106. For example, the stand off may be positioned proximate the fastener bore 128 and extend outward therefrom. Alternatively, the stand off may be created as mating notches provided in the wiping contact surfaces 118 and 132, where the notches engage one another to limit a range of travel of the main and tap conductive members 107 and 106 toward one another.

Likewise, the wedge portion 124 of the main conductive member 107 clamps the tap conductor 102 against the channel portion 112 of tap conductive member 106 and the channel portion 112 is deflected in the direction of arrow G. The channel portion 112 is elastically and plastically deflected in a radial direction indicated by arrow G, resulting in a spring back force in the direction of Arrow H opposite to the direction of arrow G. A large contact force, on the order of about 4000 lbs is provided in an exemplary embodiment, and the clamping force ensures adequate electrical connectivity between the tap conductor 102 and the connector assembly 100. Additionally, elastic spring back of the channel portion 112 provides some tolerance for deformation or compressibility of the tap conductor 102 over time, because the channel portion 112 may simply return in the direction of arrow H if the tap conductor 102 deforms due to compression forces. Actual clamping forces may be lessened in such a condition, but not to such a mount as to compromise the integrity of the electrical connection.

Unlike known bolt connectors, torque requirements for tightening of the fastener 108 are not required to satisfactorily install the connector assembly 100. When the abutment faces 116, 130 of the wedge portions 110, 124 contact the channel portions 126 and 112, the connector assembly 100 is fully mated. By virtue of the fastener elements 108 and 109 and the combined wedge action of the wedge portions 110, 124 to deflect the channel portions 112 and 126, the connector assembly 100 may be installed with hand tools, and specialized tooling, such as the explosive cartridge tooling of the AMPACT Connector system is avoided.

The displacement stop allows the nut 109 and fastener 108 to be continuously tightened until the abutment faces 116 and 130 fully seat against the channel portions 126 and 112, independent of, and without regard for, any normal forces created by the tap and main conductors 102 and 104. The contact forces are created by interference between the channel portions 126, 112, and wedge portions 110, 124, and tap and main conductors 102 and 104. The bolt torque in not referenced in the mating the connector assemble 100. Instead, the assembly 100 is fully mated when the main and tap conductive members 106 and 107 are joined to a predetermined position or relative displacement. In the fully mated condition, the interference between the conductors 102 and 104 and the connector assembly 100 produces a contact force adequate to provide a good electrical connection.

It is recognized that effective clamping force on the conductors is dependent upon the geometry of the wedge portions, dimensions of the channel portions, and size of the conductors used with the connector assembly 100. Thus, with strategic selections of angles for the wiping contact surfaces 118, 130 for example, and the radius and thickness of the curved distal ends 122 and 138 of the conductive members, varying degrees of clamping force may be realized when the conductive members 106 and 107 are used in combination as described above.

Figure 8:
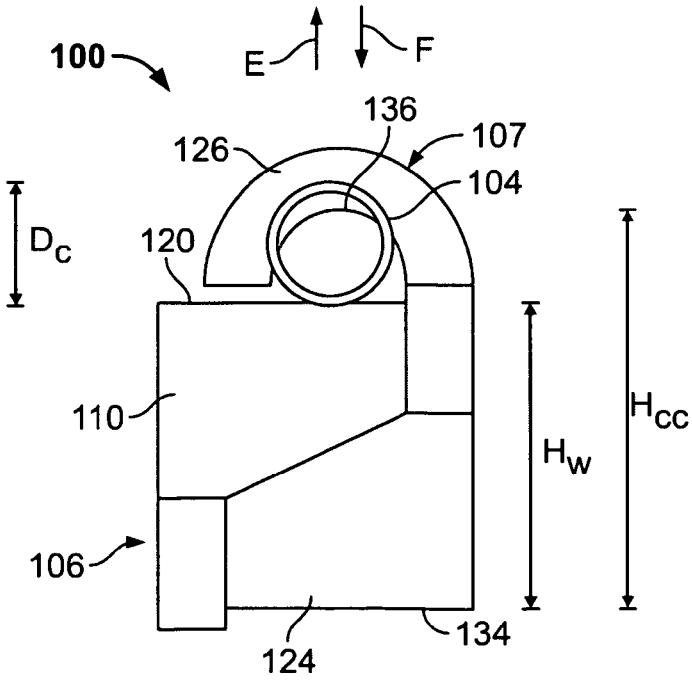
FIG. 8 is a schematic side view of a portion of the assembly shown in FIG. 2.

FIG. 8 illustrates an interference created in the connector assembly 100 that produces the deflection and spring back in the connectors. While the interference will be explained only in reference to the upper portion of the connector assembly 100, it is understood that the lower portion of the assembly operates in a similar manner. As shown in FIG. 8, the wedge portion 110 of the tap conductive member 106 and the wedge portion 124 of the main conductive member 107 are fully engaged. A wedge height $H_W$ extends between the conductor contact surfaces 120, 124 of the respective wedge portions 110, 124, and a clearance height $H_{CL}$ extends between the conductor contact surface 134 of the wedge 124 and the inner surface 136 of the main conductive member channel portion 126. The main conductor 104, however, has a diameter Dc prior to installation of the connector. An interference I is therefore created according to the following relationship:

$$I=H_W+D_C-H_{CL} \quad (2)$$

By strategically selecting $H_W$ and $H_{CL}$, repeatable and reliable performance may be provided in a similar manner as explained above in relation to FIG. 12, namely via elastic and plastic deformation of the conductive members, while eliminating a need for special tooling to assemble the connector.

Because of the deflectable channel portions 112, 126 in discrete connector components, the conductive members 106 and 107 may accommodate a greater range of conductor sizes or gages in comparison to conventional wedge connectors. Additionally, even if several versions of the conductive members 106 and 107 are provided for installation to different conductor wire sizes or gages, the assembly 100 requires a smaller inventory of parts in comparison to conventional wedge connector systems, for example, to accommodate a full range of installations in the field. That is, a relatively small family of connector parts having similarly sized and shaped wedge portions may effectively replace a much larger family of parts known to conventional wedge connector systems.

It is therefore believed that the connector assembly 100 provides the performance of conventional wedge connector systems in a lower cost connector assembly that does not require specialized tooling and a large inventory of parts to meet installation needs. Using low cost extrusion fabrication processes and known fasteners, the connector assembly 100 may be provided at low cost, while providing increased repeatability and reliability as the connector assembly 100 is installed and used. The combination wedge action of the conductive members 106 and 107 provides a reliable and consistent clamping force on the conductors 102 and 104 and is less subject to variability of clamping force when installed than either of known bolt-on or compression-type connector systems.

Figure 9:
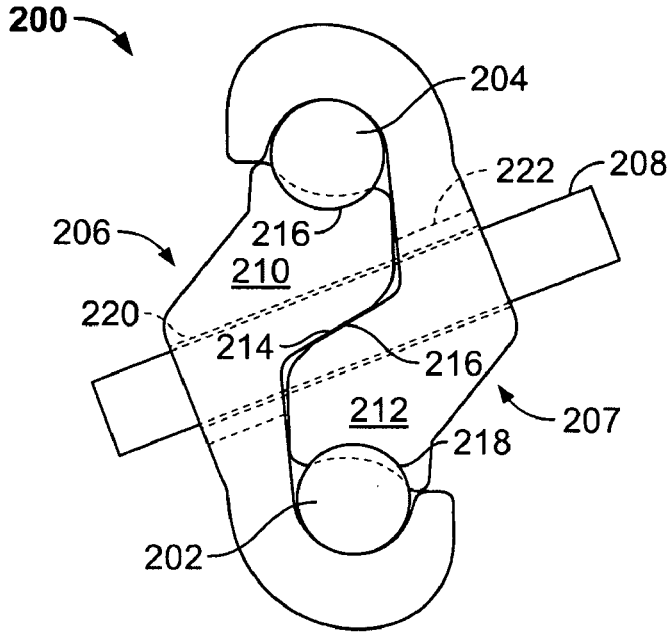
FIG. 9 is a side elevational view of another embodiment of a connector assembly formed in accordance with an exemplary embodiment of the invention.

FIG. 9 illustrates another embodiment of a connector assembly 200 that is constructed and operates in a similar manner to the assembly 100. Like the assembly 100, the assembly 200 includes a tap conductor 202, a main conductor 204, a tap conductive member 206, a main conductive member 207, and a fastener 208.

Each of the conductive members 206 and 207 are formed with respective wedge portions 210 and 212, and each of the wedge portions 210 and 212 defines a wiping contact surface 214, 216 and a conductor contact surface 216, 218. Optionally, and as shown in FIG. 9, the conductor contact surfaces 216, 218 are rounded. Also, the geometry of the wedge portions 210, 212 are such that the ends of the wedge portions defining the conductor contact surfaces 216, 218 are angled with respect to the channel portions of the conductive members 206, 207.

Additionally, in the assembly 200, the wedge portions 210 and 212 are geometrically shaped so that fastener bores 220, 222 formed through the respective wedges more readily align with the fastener 208 than in the connector assembly 100, thereby reducing, if not limiting, the tendency of the fastener 208 to float and pivot relative to the conductive members 206, 207 as the assembly 200 is installed to the conductors. This construction is believed to permit complete engagement of the conductive members 206, 207 with a reduced amount of force applied to the fastener 208

While the invention has been described in terms of various specific embodiments, those skilled in the art will recognize that the invention can be practiced with modification within the spirit and scope of the claims.

What is claimed is:

1. An electrical connector assembly comprising:

a first conductive member comprising a first hook portion extending from a first base wedge portion, the first hook portion adapted to engage a first conductor;

a second conductive member comprising a second hook portion extending from a second wedge portion, the second hook portion adapted to engage a second conductor, wherein the first wedge portion and the second wedge portion are adapted to nest with one another and be secured to one another; and a displacement stop located on the second conductive member, the first hook portion engaging the displacement stop to define a final displacement relation between the first and second conductive members once fully mated.

2. The connector assemble of claim 1, wherein the displacement stop securely engages, and defines a final mating position between, the first and second conductive members independent of an amount of force induced upon the first and second conductors by the first and second conductive members.

3. The connector assembly of claim 1, wherein the first hook portion is adapted to extend around the first conductor in a first direction, and the second hook portion is adapted to extend around the second conductor in a second direction, the second direction opposite to the first direction.

4. The connector assemble of claim 1, wherein the first wedge portion and the second wedge portion are substantially identically formed.

5. The connector assembly of claim 1, wherein the first wedge portion and the second wedge portion each include a wiping contact surface.

6. The connector assembly of claim 1, further comprising a fastener coupling the first wedge portion to the second wedge portion.

7. The connector assembly of claim 1, wherein each of the first and second wedge portions comprise a fastener bore, the connector further comprising a fastener extended through the fastener bore of the first and second wedge portion, the fastener extending obliquely to each of the fastener bores.

8. The connector assembly of claim 1, wherein the first wedge portion comprises a first conductor contact surface, the second wedge portion comprising a second conductor contact surface, the first conductor contact surface located adjacent the second book portion and the second conductor contact surface located adjacent the first hook portion.

9. An electrical connector assembly for power utility transmission conductors, the assembly comprising:

a first conductive member and a second conductive member separately fabricated from one another, each of the first and second conductive member comprising a wedge portion and a deflectable channel portion extending from the wedge portion, the channel portion of the first conductive member adapted to receive a first conductor at a spaced location from the wedge portion of the first conductive member and the channel portion of the second conductive member adapted to receive a second conductor at a spaced location from the wedge portion of the second conductive member;

wherein the wedge portion of the first conductive member is configured to nest within and be secured to the wedge portion of the second conductive member and wherein the wedge portion of the second conductive member is configured to nest within and be secured to the wedge portion of the first conductive member; and a fastener extending through the wedge portion of each of the first and second conductive members to join the first and second conductive members to one another wherein the first conductor is captured between the channel portion of the first conductive member and the wedge portion of the second conductive member, and further wherein the second conductor is captured between the channel portion of the second conductive member and the wedge portion of the first conductive member when the first and second conductive members are joined to one another.

10. The connector assembly of claim 9, wherein the channel portion of the first conductive member extends circumferentially around a first conductor in a first direction, and the channel portion of the second conductive member extends circumferentially around a second conductor in a second direction, the second direction being opposite to the first direction.

11. The connector assembly of claim 9, further comprising a displacement stop located on at least one of the first and second conductive members, the displacement stop being positioned to define a final displacement relation between the first and second conductive members once fully mated.

12. The connector assembly of claim 9, wherein the channel portion of each of the first and second conductive members includes a distal end, the distal end of the first conductive member facing the wedge portion of the second conductive member, and the distal end of the second conductive member facing the wedge portion of the first conductive member.

13. The connector assembly of claim 9, further comprising a displacement stop positioned to securely engage, and define a final mating position between, the first and second conductive members independent of an amount of force induced upon the first and second conductors by the first and second conductive members.

14. The connector assembly of claim 9, wherein the wedge portions of the first and second conductive members include a wiping contact surface.

15. The connector assembly of claim 9, wherein each of the first and second wedge portions comprise a fastener bore, the fastener extending through the fastener bores of the wedge portions.

16. The connector assembly of claim 9, wherein the wedge portion of each of the first and second conductive members comprises a conductor contact surface, the conductor contact surfaces of each of the first and second conductive members extending away from one another.

17. An electrical connector assembly for power utility transmission, the assembly comprising:

a first conductive member and a second conductive member separately fabricated from one another, each of the first and second conductive member comprising a wedge portion and a deflectable channel portion extending from the wedge portion;

the channel portion of the first conductive member configured for receiving a main power line conductor at a spaced location from the wedge portion;

the channel portion of the second conductive member configured for receiving a tap line conductor at a spaced location from the wedge portion;

the wedge portions of the first and second conductive members being substantially identically formed with one another and being in abutting contact and interfitting with one another; and a fastener joining the wedge portion of the first and second conductive members to one another;

wherein the main power line conductor is captured between the channel portion of the first conductive member and the wedge portion of the second conductive member, and further wherein the tap line conductor is captured between the channel portion of the second conductive member and the wedge portion of the first conductive member.

18. The connector assembly of claim 17, wherein the channel portion of the first conductive member extends circumferentially around a first conductor in a first radial direction, and the channel portion of the second conductive member extends circumferentially around a second conductor in a second radial direction, the second direction being opposite to the first direction.

19. The connector assembly of claim 17, wherein the channel portions of the first and second conductive members are formed geometrically similar with one another and sized differently from one another.

20. The connector assembly of claim 17, wherein the wedge portions of the first and second conductive members include a wiping contact surface.

21. The connector assembly of claim 17, wherein each of the first and second wedge portions comprise a fastener bore, the fastener extending through the fastener bores of the wedge portions.

22. The connector assembly of claim 17, further comprising a displacement stop located on at least one of the first and second conductive members, the displacement stop being positioned to define a final displacement relation between the first and second conductive members once fully mated.

23. The connector assembly of claim 17, further comprising a displacement stop positioned to securely engage, and define a final mating position between, the first and second conductive members independent of an amount of force induced upon the main power and tap line conductors by the first and second conductive members.

* * * * *